US008408964B1

(12) United States Patent
Acker et al.

(10) Patent No.: US 8,408,964 B1
(45) Date of Patent: Apr. 2, 2013

(54) GIRTH REDUCING DEVICE

(76) Inventors: Ricky J. Acker, Medford, WI (US); Dixie L. Telisak, Cornell, WI (US)

( * ) Notice: Subject to any disclaimer, the term of this patent is extended or adjusted under 35 U.S.C. 154(b) by 323 days.

(21) Appl. No.: 12/910,202

(22) Filed: Oct. 22, 2010

(51) Int. Cl.
*A41C 3/00* (2006.01)

(52) U.S. Cl. ..... 450/82; 450/86; 2/336

(58) Field of Classification Search ..... 450/82, 450/86, 1; 2/310–312, 322, 323, 338, 336
See application file for complete search history.

(56) References Cited

U.S. PATENT DOCUMENTS 2,602,929 A * 7/1952 Chasinov ..... 450/82
2,653,323 A * 9/1953 Ganim ..... 450/82
2,668,954 A * 2/1954 Frohlich ..... 450/82
4,564,983 A 1/1986 Saito
6,123,601 A * 9/2000 Hildebrandt ..... 450/82
6,520,832 B2 2/2003 Devita et al.
7,232,359 B1 6/2007 Richardson
7,648,408 B2 1/2010 Lung
2006/0094334 A1 5/2006 Davis et al.

* cited by examiner

*Primary Examiner* — Gloria Hale
(74) *Attorney, Agent, or Firm* — Anthony J Bourget

(57) ABSTRACT

The invention includes a girth reducing device including a connector, an extension affixed to the connector and fasteners affixed to the extension. The connector may connect to a back band of a bra assembly and the fasteners affixed to the extension may connect to another back band of the bra assembly. The connections may be made in a manner that allows for a reduced girth of the bra from a smallest girth possible utilizing existing coupling systems of the bra.

18 Claims, 5 Drawing Sheets

GIRTH REDUCING DEVICE

BACKGROUND

1. Field of the Invention

The present invention relates generally to shortening devices, and more specifically to shortening devices that may be retrofitted onto existing systems or products to reduce a circumference or girth of those systems or products, along with methods of using such shortening devices.

2. Background Information

Shortening devices may take on many forms and may be used in conjunction with existing products. For example, a shoelace system is a system for shortening a distance across a tongue of a shoe; brassiere straps are known to have sliding adjusters to adjust the length of the straps; and brassieres ("bras") are known to have multiple sets of hooks or loops so as to be able to adjust the lengths of the back bands of a bra. Moreover, many types of clothing and undergarments utilize methods of presenting the size of that clothing (e.g., L—Large, M—Medium, S—Small) and then also provide for some existing, fixed adjustment of those presented sizes.

As an example of specifically-sized undergarments having fixed adjustment systems, bras are classified and offered to the public in combinations of back band sizes and cup sizes, e.g., typically 34A-C, 36B-D, etc., where the number indicates the back band size and the letter indicates the cup size. Existing coupling systems of the bras classified under this system often allow for a limited number of adjustments at fixed locations on the back bands.

While the prior art has provided examples of features allowing for limited adjustment of undergarments, there is always room for further improvement.

SUMMARY OF THE INVENTION

Although back band adjustment systems are known, the inventors have realized deficiencies with such systems and have developed improvements thereon. For example, Applicants have realized that in the situation where a bra band utilizes a slide connection and adjustment mechanism similar to that generally seen on a bra strap, the back band often fails to maintain a constant girth of the bra assembly during use as the slide adjustment mechanism is subject to readjustment during regular wear by a user of the bra. Moreover, Applicants have realized that known adjusting devices fail to teach a retrofitting adjustment system that may be used to shorten or reduce a back band of a bra to a size at least as small as the smallest circumference possible by use of the original back band coupling system, while utilizing portions of that existing back band coupling system. Applicants have realized these, and other, deficiencies of the prior art back band connection and shortening devices and methods, and have combined the below objectives in a novel manner to provide a back band shortening device that may be retrofitted onto a back band of a bra.

In accordance with an aspect of the invention, the device is directed toward a shortening system usable with bras having particular sizes. Generally, the inventive device includes a releasable and adjustable connection mechanism connected to an extension piece of flexible material that has a back band connector capable of making a connection with existing back band connection mechanisms. The connection mechanism may be any type of connector capable of repeatedly releasing and engaging a first back band. For example, the releasable and adjustable connector may have a slot for slidingly receiving a first back band and through which the first back band is engaged by portions of the clip. The releasable and adjustable connector may be any connection mechanism that may be retrofitted onto a back band and is adjustable along the back band. Yet further, the clip may comprise a flat portion or base plate that contacts the back of a person wearing the bra. The extension may extend from a portion of the clip at a first end of the extension and may include at least one set of a back band fasteners similar to the back band fasteners of the first back band.

In operation, an embodiment of the invention may include sliding a first back band having a portion of a coupling system through an opening of the clip so that the flat portion would contact a user of the bra assembly with the first back band and then releasably engaging the clip with the first back band at a position between a first end and a second end of the first back band. Once the clip is releasably secured to the first back band, the fastener extending from the extension may be connected to a mating fastener affixed to the second end of the second back band.

Further, the device and method may take on any configuration that is capable of being retrofitted onto a bra so as to connect a first back band with a second back band in a manner that reduces the circumference or girth of the bra assembly comprising the first and second back bands.

An object of the invention is to provide a device that allows for the shortening of a circumference or girth of a combined cup assembly and back band assembly.

An object of the invention is to provide an improved fit of a bra after the bra has been stretched-out from its original form.

An object of the invention is to provide an improved fit of undergarments after a user has lost weight or has experienced a change in mass location since obtaining the undergarment.

A further object of the invention is to provide a retrofitting device and method that allows for adjustable retrofitting of a shortening device onto a back band of an undergarment.

A further object of the invention of is to provide a retrofitting device that may be adjustable about a first back band and couples with existing back band connectors of a second back band.

A further object of the invention is to provide a shortening device that is comfortable for a user to wear and is minimally noticeable through clothing worn over the undergarment.

The above summary of the present invention is not intended to describe each illustrated embodiment, aspect, or every implementation of the present invention. The figures and detailed description that follow more particularly exemplify these and other embodiments and further aspects of the invention.

BRIEF DESCRIPTION OF THE DRAWINGS

The invention may be more completely understood in consideration of the following description of various embodiments of the invention in connection with the accompanying drawings, in which.

DETAILED DESCRIPTION OF THE INVENTION

Figure 7:
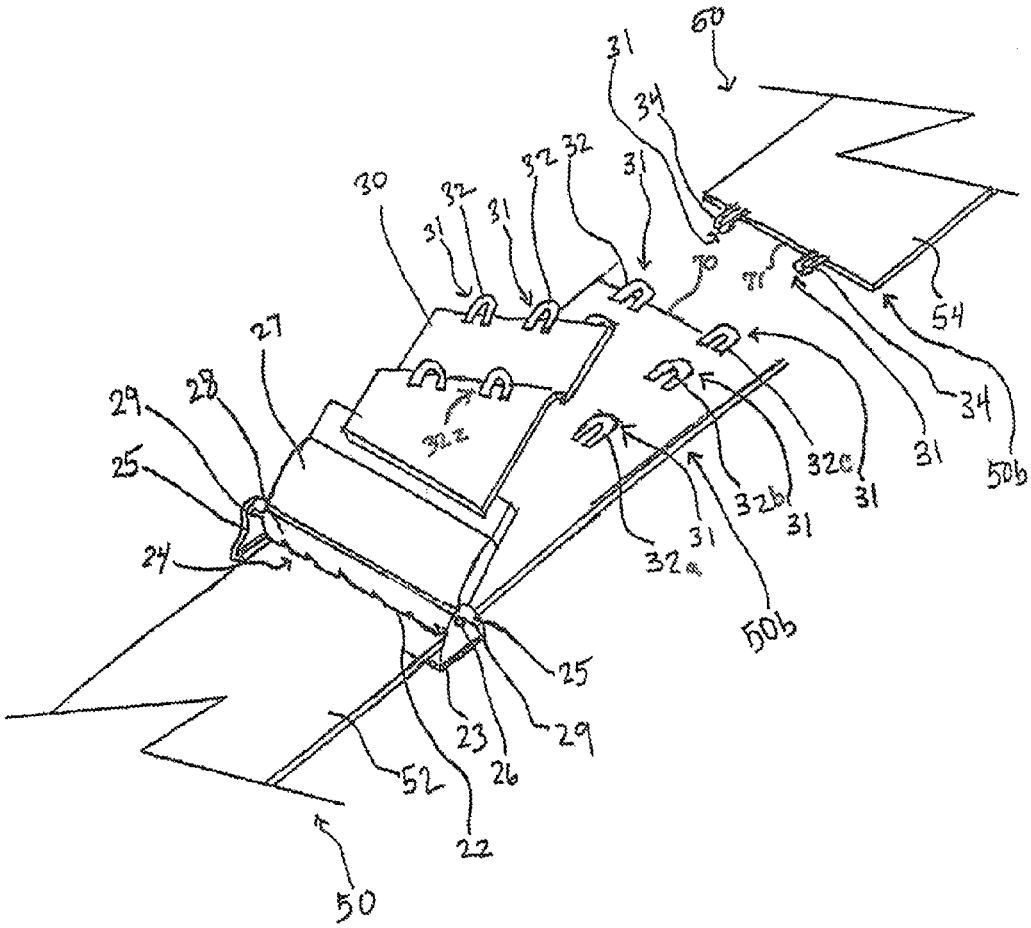
FIG. 7 is a perspective view of features of the invention.
Figure 8:
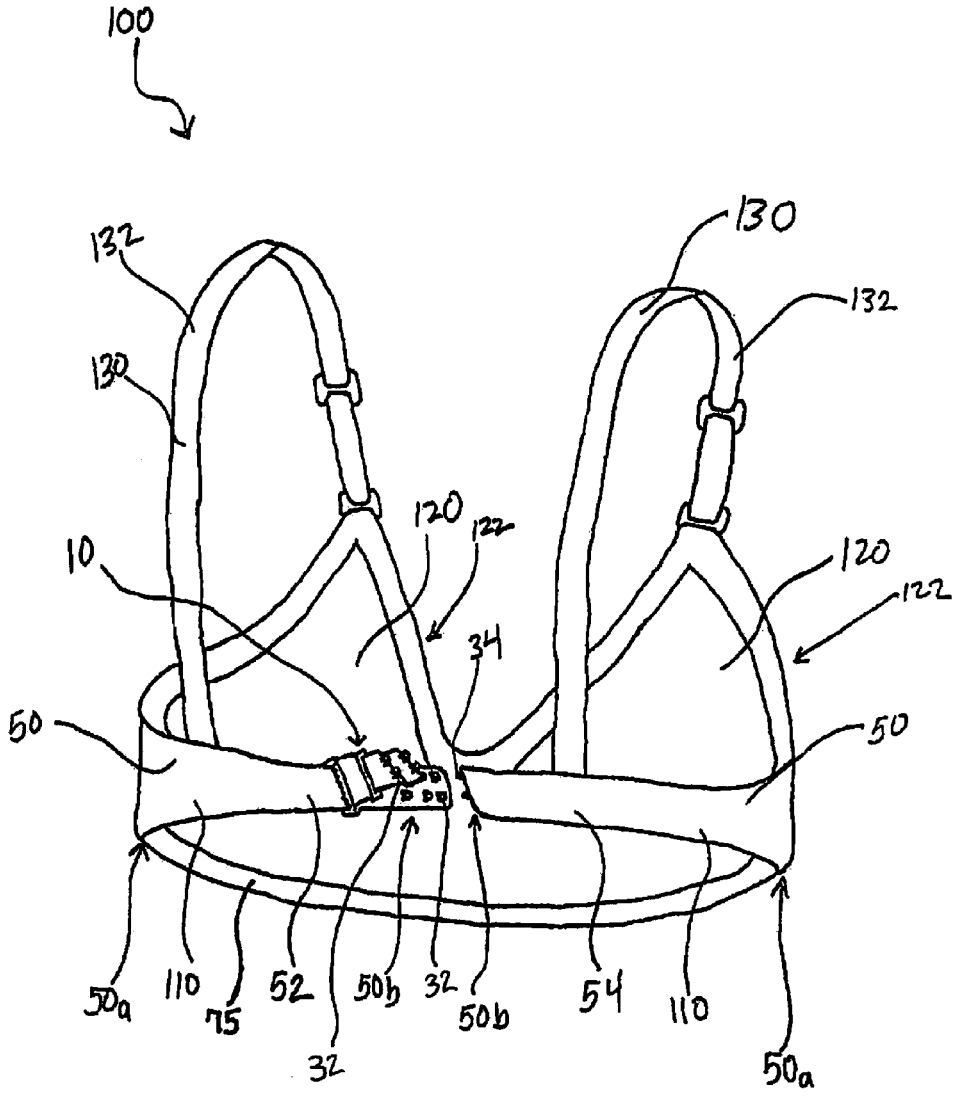
FIG. 8 is a perspective rear view of a bra arrangement utilizing features of the invention While the invention is amenable to various modifications and alternative forms, specifics thereof have been shown by way of example in the drawings and will be described in detail. It should be understood, however, that the intention is not necessarily to limit the invention of the particular embodiments described.

Referring now to FIGS. 1-8, the invention is directed to a shortening system 10 used with a bra assembly 100 of any particular size and methods of using shortening system 10. As depicted in FIG. 8, undergarments, particularly bras, generally have a strap assembly 130 (unless the bra is of the strapless version), a cup assembly 120 and a back band assembly 110. Strap assembly 130 often comprises two straps 132, where one strap 132 is meant to traverse each shoulder and is connected to a cup 122 of cup assembly 120 at a first end and a back band 50 of back band assembly 110 at a second end. Straps 122 are often slidably adjustable and may take on numerous designs to be hidden under clothing, if so desired. Cup assembly 120 generally comprises two cups 122, where cups 122 are connected at one end to each other and are connected to back bands 50 at respective second ends. Back band assembly 110 often comprises two back bands 50 that connect to respective cups 122 at a first end 50*a* and connect to each other at respective second ends 50*b*. Second ends 50*b* of back bands 50 may connect through a coupling system. The coupling system may include first fasteners 32 affixed to a first back band 52 and second fasteners 34 affixed to a second back band 54.

Figure 1:
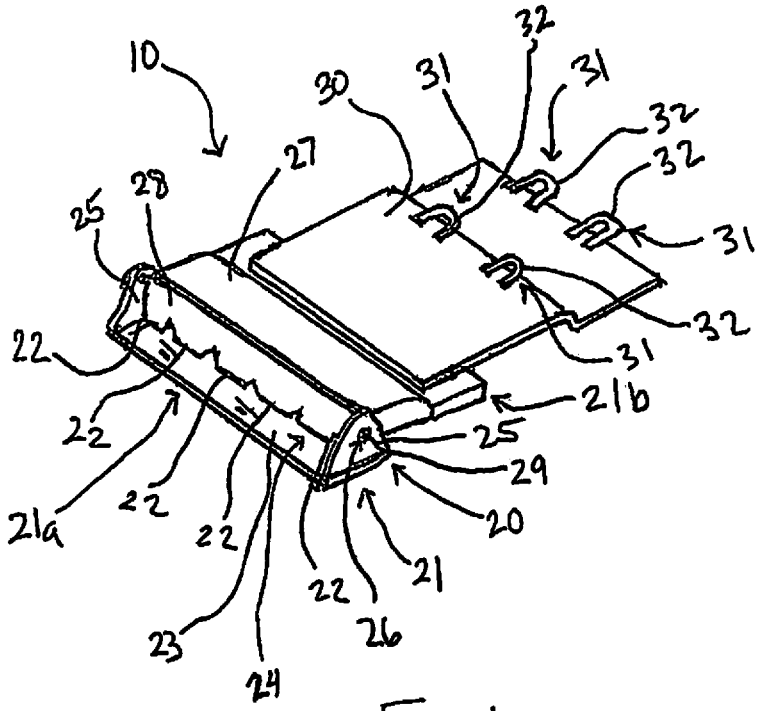
FIG. 1 is a perspective view of features of the invention.
Figure 2:
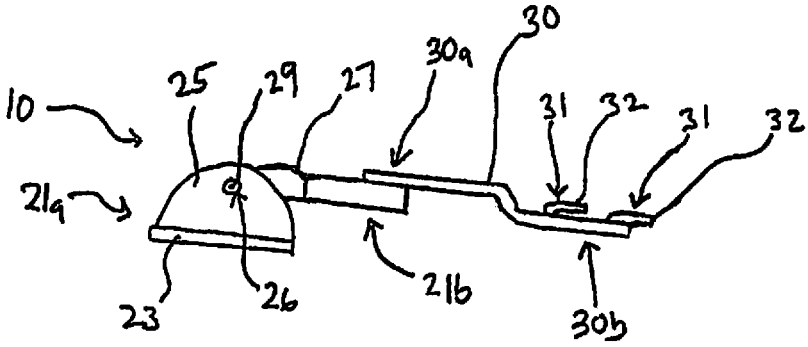
FIG. 2 is a side plan view of the features in FIG. 1
Figure 3:
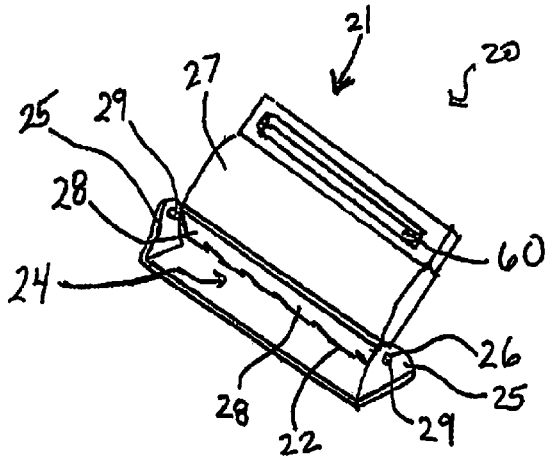
FIG. 3 is a perspective view of features of the invention.
Figure 4:
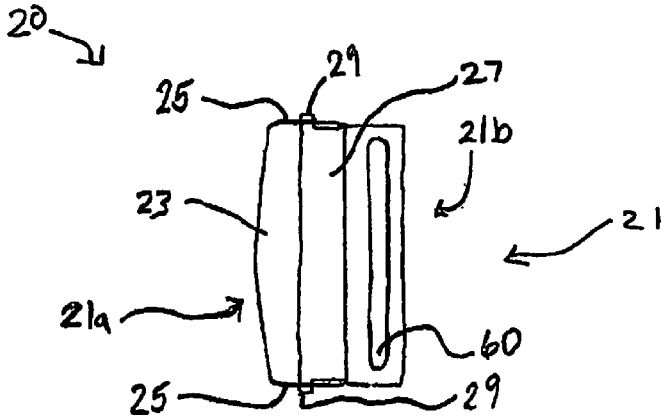
FIG. 4 is a top plan view of the features in FIG. 3.

Generally, system 10 comprises, as seen in FIGS. 1 and 2, an adjustable connector 20 connected to an extension 30 that may have at least one fastening element 31 affixed thereto. Fastening element 31 affixed to extension 30 may be a first fastener 32 capable of being coupled with existing second fasteners 34 affixed to second back band 54. Alternatively, or in addition, second fasteners 34 may be affixed to extension 30 so as to be capable of coupling with existing first fasteners 32 affixed to first back band 52.

Connector 20 may be any type of connector capable of repeatedly releasing and engaging a first back band 52. For example, as seen in FIGS. 1-7, connector 20 may be a clip 21 having an opening 24 for slidingly and circumferentially receiving a back band 50 and through which back band 50 may be engaged by pressure portions 22 of clip 21. The releasable and adjustable connector 20 may be any connection mechanism that may be retrofitted onto back bands 50 and is adjustable along back bands 50.

In an embodiment, connector 20 may be clip 21. As best seen in FIGS. 3-6, clip 21 may be integrally formed or may have multiple components 21*a*, 21*b*. First component 21*a* may be a frame and second component 21*b* may be an operative member. First component 21*a* may comprise a base plate 23, side walls 25, preferably formed at opposite ends of base plate 23. Base plate 23 may be substantially flat so as to be comfortable for abutting user of the device and to smoothly contact back band 50, as described below. Side walls 25 may have at least one receiver 26, where receiver 26 may be a hole or indentation or notch or other mechanism for receiving second component 21*b*. Alternatively, or additionally, receiver may be a tab or projection that inserts into an associated releif or receiver of second component 21*b*. Receivers 26 may be any mechanism capable of allowing second component 21*b* to rotate about an axis connecting receivers 26 while second component 21*b* is received with receivers 26.

Figure 5:
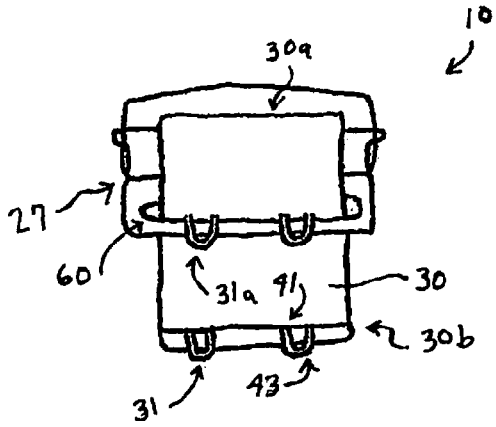
FIG. 5 is a plan view of a further aspect of features of the invention.
Figure 6:
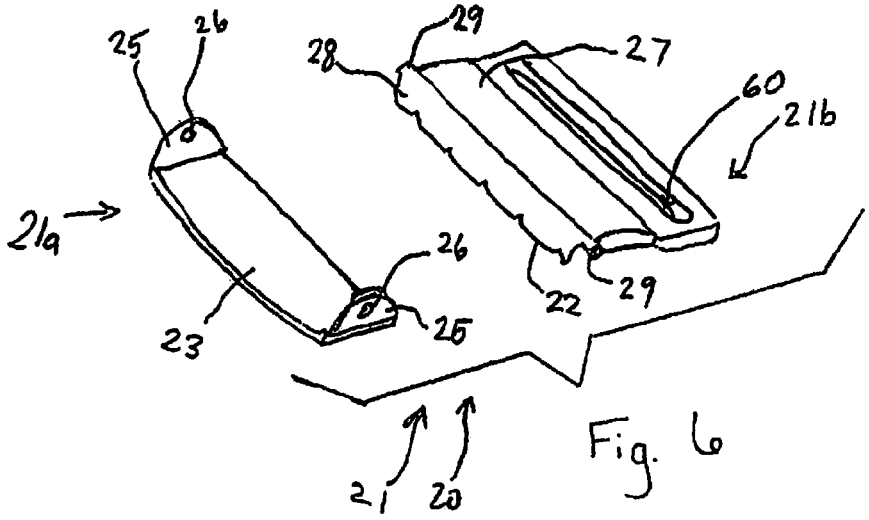
FIG. 6 is an exploded perspective view of the features in FIG. 3.

Second component 21*b* may be an operator member having a body portion 27 and a connector portion 28 connected to (e.g., formed therewith) and extending from an end of body portion 27 at any angle; for example, connector portion 28 may extend substantially perpendicular to body portion 27. Connector portion 28 may have, and terminate at, pressure portions 22 (e.g., teeth, which may be jagged or flat with spaces there between or may take on other forms) at an end opposite the end connected to body portion 27. Further, wings 29 may extend from body portion 27, so as to be axially aligned and project laterally outwardly from body portion 27 in opposite directions. Body portion 27 may also include a slot or slots 60 capable of receiving extension 30 or receiving a mechanism affixing extension 30 to body potion 27. Extension 30 may be received by body portion 27 in any manner or may be affixed to body portion 27 in any manner; for example, extension 30 may be wrapped around body portion 27; extension 30 may be glued to body portion 27; extension 30 may be riveted to body portion 27; or extension 30 may be attached, affixed or connected to body portion 27 in a different manner or a combination thereof. In one aspect as seen in FIG. 5 extension 30 is positioned within slot 60 and connected to body portion 27. Extension 30 may overlap body portion 27 to secure with part of connector portion 28 if desired. Extension 30 may be glued to clip 21. Fastener 31*a* may overlap a portion of clip 21 for desired stability and may be relatively rigidly connected to clip 21 as compared to fastener 31 that is connected at a flexible and second end 30*b* of extension 30.

Wings 29 of second component 21*a* may rotationally engage receivers 26 of first component 21*b*. Such engagement allows second component 21*a* to rotate about an axis substantially through a center of receivers and wings. Wings 29 may allow for second component 21*a* to rotate with respect to an object (e.g., back band 50) received within an opening 24 when connector 20 is in an open position. Connector 20 may have an open position when pressure portions 22 are not in contact with base plate 23 of first component 21*a*. Through rotation of first component 21*a* the pressure placed on the received object by pressure portions 22 and base plate 23 may be adjusted. The amount of pressure placed on the received object may be adjusted or maintained through controlling the distance between base plate 23 (or received object, or both) and pressure portions 22. A spring may be utilized to increase or decrease the pressure on a received object. When pressure portions 22 are in contact with a received object or base plate 23, connector 20 is in a closed position.

As seen in FIGS. 1, 2 and 8, extension 30 may be affixed to connector 20 at any position, using any known connection mechanism; for example, gluing or riveting or other connecting mechanism may be utilize to affix extension 30 to connector 20. In an embodiment utilizing clip 21, extension 30 may be affixed to body portion 27. Extension 30 may be made of any material; for example a flexible material. The flexible material may be material similar to, or identical to, the material of a bra to which shortening system 10 is to be attached or it may be a different material. A different material may include a clear flexible material so as not to clash with the material of the retrofitted bra.

Extension 30 may be any size having enough space to allow a portion of extension 30 to connect to connector 20 and a portion to which fastening elements may be affixed. Extension 30 may have a first end 30*a* and a second end 30*b*. First end 30*a* of extension 30 may be defined as the portion of extension 30 connected to connector 20 or overlapping connector 20 when shortening system 10 is in use. Second end 30*b* of extension 30 may be defined as the portion of extension 30 having fastening elements 31 connected thereto.

Extension 30 may have fastening elements 31 affixed to second end 30*b*. Fastening elements 31 affixed to second end 30 may be first fasteners 32 or second fasteners 34, or both. At a minimum, a portion of the fastening elements 31 affixed to extension 30 may be the same type as the fastening elements 31 affixed to back band 50 to which shortening system 10 is connected. As may be appreciated, fasteners 32 may be configured differently as compared to fasteners 34. In one aspect first fasteners 32 may be generally female-type of fasteners 31 while second fasteners 34 may be male-type fasteners 31 capable of connecting with the first fasteners 32.

Bras utilize a variety of coupling systems. An example of a coupling system is a system where the back band assembly of a bra comprises two back bands, 52, 54 and at least one first fastener 32 may be affixed to a first back band 52 and at least one second fastener 34 may be affixed to a second back band 54. First fasteners 32 may be comprised of eyes or loops or other female connectors having a first end connected to first back band 52 and a second end, which may be free, extending from first back band 52. Second fasteners 34 may be comprised of hooks or other male connectors capable of engaging the female connectors of first fasteners 32 and having a first end connected to second back band 54 and second end, which may be free, extending from second back band 54.

In addition, extension 30 may include fastening elements 31. For example, a second end 30*b* of extension 30 comprise at least one first fastener 32. The number of fastening elements 31 on extension 30 may be proportional to the number and type of fastening elements 31 to which extension 30 is to be connected. For example, as seen in FIG. 7, if shortening system 10 is applied to a back band assembly 110 comprising first back band 52 having three columns of two rows of first fasteners 32 and second back band 54 having one column of two second fasteners 34 and system 10 is applied to first back band 52, extension 30 may have at least a single column of two first fasteners 32 for connection to second fasteners 34 affixed to second back band 54. Extension 30 may comprise fastening elements 31 of a first fastener 32 or a second fastener 34 or a different fastener or a combination thereof. As seen in the various drawings, including as seen in FIG. 5, fastener 31 preferably includes a fastening element first end 41 that is affixed to extension 30 and a fastening element second end 43 that extends from the extension 30. Second end 43 may extend from extension 30 in a variety of ways, including but no limited to extending over a perimeter edge of extension 30 or extending upwards from extension 30 or in other ways. Fastening elements 31 may include other types of devices that have a first end that affixes to extension 30 and a second end that extends from extension 30, including but not limited to snaps or clips or other fasteners.

In operation, shortening system 10 may be used with, or retrofitted on, any typical bra assembly 100 having a coupling system similar to that of system 10. Generally, adjustable connector 20 of shortening system 10 may be connected to one of first back band 52 and second back band 54, and fastening elements 31 of extension 30 may be coupled to the other of first back band 52 and second back band 54. Prior to engaging system 10 with back band 50, it may be ensured that a back band 50 opposite another back band 50 to which connector 20 is connected may couple with fastening elements 31 on extension 30. That is, shortening system 10 may utilize fastening elements that are capable of coupling with the original coupling system of the bra.

More specifically, in an example where back bands 50 are connected to cups of a cup assembly at first ends 50*a* and have fastening elements 31 affixed to a second end 50*b*, a clip 21 of shortening system 10 may be connected to first back band 52 at a position between its first end 50*a* and its second end 50*b*. Further, extension 30 may comprise first fasteners 32 that are similar, or identical, to first fasteners 32 affixed to first back band 52 and which may be coupled to second fasteners 34 affixed to second end 50*b* of second back band 52. A first end 50*a* of back bands 50 is defined as the portion of back band 50 connected to a cup of cup assembly 120. A second end 50*b* of back bands 50 is defined as the portion of back band 50 comprising fastening elements 31.

In the example, prior to connecting clip 21 to first back band 52, second component 21*b* of clip 21 may be adjusted with respect to first component 21*a* to place the clip in an open position and form opening 24. Then first back band 52 may be inserted into and through opening 24 so that clip 21 circumferentially receives first back band 52 and a substantially flat portion of base plate 23 is positioned to contact a user of system 10. The first back band 52 has been inserted into and through opening 24 once: 1) a portion of first back band 52 between first end 50*a* and second 50*b* is substantially surrounded by connected first component 21*a* and second component 21*b* of clip 21; 2) first end 50*a* of first back band 52 is on a first side of connector 20; and 3) second end 50*b* of first back band 52 is on a second side of connector 20.

Continuing in the example, once first back band 52 has been threaded through opening 24, clip 21 may connect to first back band 52 at a position between first end 50*a* and second end 50*b*. Clip 21 may be connected to first back band 52 by closing opening 24 through adjusting body portion 27 in a manner that reduces a space or distance between pressure portion 22 of connector portion 28 and base plate 23. By closing opening 24, a releasable connection between clip 21 and first back band 52 may be achieved. It should be noted that the nature of system 10 is to allow the system to be adjusted along a back band 50 between first end 50*a* and second end 50*b*, thereby allowing a user to reduce the girth of the back band assembly 110 and cup assembly 120 greater than allowed by the original coupling system of the bra. When the girth of the back band assembly 110 has been reduced, second end 50*b* of first back band 52 may extend free or be wrapped into the back band assembly or may be engaged with another portion of the bra, as it may be considered excess.

Yet still in the example, after connecting system 10 to first back band 52, first fasteners 32 may be coupled with second fasteners 34 on second end 30*b* of second back band 54. That is, if first back band 52, to which system 10 is connected, utilizes first fasteners 32 that are female connectors, extension 30 will comprise first fasteners 32 that are also female and that may be coupled with male second fasteners 32 of second back band 54.

Alternatively, or in addition, system 10 may comprise second fasteners 32. Such an arrangement of system 10 may allow for methods of using system 10 with either back band 50 of a back band assembly 110, regardless of the fastening elements attached to bands 50. Moreover, systems 10 having male fasteners, female fasteners or both fastener types, allow for the use of systems 10 on both back bands 52, 54 at the same time (assuming two systems 10 are utilized). By using system 10 on both back bands 52, 54 users may enjoy greater adjustment of the cup and back band assembly girth and the ability to have symmetry in any girth adjustment.

Although system 10 has been described in reference to a bra assembly 100, system 10 may be used in any method that involves shortening or reducing a girth. Moreover, although system 10 has been described utilizing hook and loop type connectors, system 10 may utilize and be utilized with any type of connectors or objects with connectors.

With further reference to FIG. 7 and FIG. 8, first back band 52 may be connected to second back band 54 to define a circumferential length of the brassiere. The circumferential length will vary depending upon the length of back bands 52, 54, the length of cup assembly 120 and the positioning of first fasteners 32 and second fasteners 34. It may be appreciated that second fasteners 34 may fasten to different sets of first fasteners 32 as shown in FIG. 7 and FIG. 8. It may be appreciated that a second fastener 34 may connect to first fastener 32*c* to define a circumferential length of brassiere. Particularly, the circumferential length in such case is the measure of the distance from the end line 70 along first back band 52, along front band 75 (See FIG. 8), and along second back band 54 to end line 71 (in a case where end line 70 abuts end line 71). It may be appreciated that fabric used to make brassiere may be flexible so that variations of the circumferential length may be present.

Continuing with reference to FIG. 7 and FIG. 8, it may also be appreciated that second fastener 34 may connect to a first fastener 32*b*, for example, to define a circumferential length of brassiere that is less than the circumferential length defined where second fastener 34 connects to first fastener 32*c*. In such case it may be appreciated that second back band 54 may in part overlap first back band 52 such that end line 71 is positioned inward from end line 70 along first back band 52. It may also be appreciated that a second fastener 34 may connect to a first fastener 32*a* to define a circumferential length of brassiere that is less than the circumferential length defined where second faster 34 connects to first fastener 32*b*. It may be appreciated that additional sets of first fasteners 32 may be positioned on first back band 52 so that varying positions can be used with corresponding variety of the circumferential length of brassiere. It may be appreciated that a first fastener 32, such as first fastener 32*a* may comprise an inner-most fastener 32 (i.e. a fastener 32 positioned on back band 52 which is furthermost from end line 70 as compared to other fastener 32 that may be positioned on back band 52. A minimal circumferential length associated with brassiere is defined as the circumferential length of brassiere where second fastener 34 connects to inner-most fastener 32. In the example of FIG. 7, the minimal circumferential length of brassiere is present where second fastener 34 fastens to inner-most fastener 32*a*. It may be appreciated that additional fasteners 32 may be included to vary the minimal circumferential length of brassiere. The minimal circumferential length of brassiere is typically established upon fabrication of the brassiere. Use of connector 20 allows for modification of the minimal circumferential length of brassiere as may be appreciated.

Connector 20 which affixes to a back band such as first back band 52 includes a fastener such as fastener 32. In one example connector 20 is positioned such that fastener 32*z* is positioned between inner-most fastener 32*a* and first end 50*a* of band 52. It may be appreciated in one example that connector 20 may affix to back band 52 between end line 70 and strap 132 which connects to band 52. Connector 20 effectively adds an inner-most fastener or fasteners 32 for use in conjunction with band 52. Such addition accommodates modification of the minimal circumferential length of brassiere. For instance, second fastener 34 may connect to inner-most fastener 32*z* to effectively reduce the minimal circumferential length of brassiere to establish a reduced minimal circumferential length of brassiere.

The terms and descriptions used herein are set forth by way of illustration only and are not meant as limitations. Those skilled in the art will recognize that many variations are possible within the spirit and scope of the invention as defined in the following claims, and their equivalents, in which all terms are to be understood in their broadest possible sense unless otherwise specifically indicated. While the particular GIRTH REDUCING DEVICE as herein shown and described in detail is fully capable of attaining the above-described aspects of the invention, it is to be understood that it is the presently preferred embodiment of the present invention and thus, is representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. section 112, sixth paragraph, unless the element is expressly recited using the phrase "means for."

What is claimed is:

1. A brassiere connector device for connecting a first back band of a brassiere to a second back band of the brassiere to reduce a circumferential length of the brassiere where the first back band extends from a first end adjacent a first cup of the brassiere to a second end and includes at least one fastening element positioned at the second end of the first back band, the second back band includes at least one fastening element positioned at an end of the second back band, said brassiere connector device comprising:

a connector having at least one fastening element configured to fasten to the at least one fastening element positioned at the end of the second back band, said connector configured to adjustably secure to a fixed position on the first back band where said at least one fastening element of said connector is positioned between the first end of the first back band and the fastening element at the second end of the first back band.

2. The device of claim 1 where said connector includes a clamping mechanism, said clamping mechanism configured to adjustably secure to the fixed position on the first back band.

3. The device of claim 2 where said clamping mechanism is a clip.

4. The device of claim 2 where said clamping mechanism includes an adjustable opening through which said connector receives the first back band.

5. The device of claim 1 where said connector includes at least two fastening elements configured to fasten to fastening elements of the second back band.

6. The device of claim 1 where said connector includes an extension, said at least one fastening element is secured to said extension.

7. The device of claim 1 where said connector includes an opening configured to receive the first back band.

8. The device of claim 6 where said connector is a clip and where said extension is affixed to said clip.

9. The device of claim 6 where said extension is flexible.

10. The device of claim 1 where said connector includes a plurality of fastening elements.

11. A brassiere comprising:

a cup assembly having a first end and a second end;

a back band assembly, said back band assembly comprising:

a first back band having a first end connected to said first end of said cup assembly;

a second back band having a first end connected to said second end of said cup assembly; and a fastening system having first fasteners at a second end of said first back band and second fasteners at a second end of said second back band, where said second fasteners are capable of fastening to said first fasteners; and a brassiere connector device, said brassiere connector device comprising:

a connector having at least one fastening element configured to fasten to at least one of said second fasteners, said connector configured to adjustably secure to a fixed position on said first back band where said at least one fastening element is positioned between said first end of said first back band and said first fasteners of said first back band.

12. The brassiere of claim 11 where said connector includes a clamping mechanism securable in a fixed position on said first back band.

13. The brassiere of claim 11 where said connector includes an extension, said at least one fastening element is secured to said extension.

14. The brassier of claim 11 where said connector is configured to adjust and secure to said first back band at substantially any position along said first back band.

15. A method of connecting a first back band of a brassiere to a second back band of the brassiere to reduce a minimal circumferential length of the brassiere where the first back band extends from a first end adjacent a first cup of the brassiere to a second end and includes at least one fastening element positioned at the second end of the first back band, the second back band includes at least one fastening element positioned at an end of the second back band, said method comprising:

connecting a connector to the first back band between the second end of the first back band and a strap that connects to the first back band, the connector including at least one fastening element; and connecting the at least one fastening element of the connector to the at least one fastening element positioned at the end of the second back band where said connecting the connector reduces the minimal circumferential length of the brassiere.

16. The method of claim 15 where said connecting a connector to the first back band includes fixedly connecting the connector at any position along the first back band between the strap and an inner-most fastener of the first back band.

17. The method of claim 16 where said connecting a connector includes utilizing a connector having a clamping mechanism where the connector secures to a fixed position on the first back band.

18. The method of claim 17 where the clamping mechanism includes an adjustable opening through which the connector receives the first back band.

* * * * *